United States Patent [19]

Heflin

[11] Patent Number: 4,826,047

[45] Date of Patent: May 2, 1989

[54] HAND HELD DISPENSER FOR MIXING AND DISPENSING TWO VISCOUS COMPONENTS

[75] Inventor: Ronald D. Heflin, Martinsburg, W. Va.

[73] Assignee: E. I. Du Pont De Nemours and Company, Wilmington, Del.

[21] Appl. No.: 215,423

[22] Filed: Jun. 30, 1988

[51] Int. Cl.[4] ..... B67D 5/52

[52] U.S. Cl. ..... 222/136; 222/145; 222/327

[58] Field of Search ..... 222/135–136, 222/145, 190–191, 226, 243, 246, 323, 325–327, 464, 465.1, 526, 531–532, 541; 366/184, 194–195; 604/82, 89, 91

[56] References Cited

U.S. PATENT DOCUMENTS

| | | | |
|---|---|---|---|
| 3,144,966 | 8/1964 | Cook | 222/136 |
| 3,153,531 | 10/1964 | Cook | 222/136 |
| 3,370,754 | 2/1968 | Cook et al. | 222/136 X |
| 3,735,900 | 5/1973 | Gores | 222/145 |
| 4,340,154 | 7/1982 | Van Manen | 222/94 |
| 4,371,094 | 2/1983 | Hutter, III | 222/1 |
| 4,676,406 | 6/1987 | Frischmann et al. | 222/136 |
| 4,776,704 | 10/1988 | Kopunek et al. | 366/184 |

FOREIGN PATENT DOCUMENTS

| | | | |
|---|---|---|---|
| 2758017 | 7/1979 | Fed. Rep. of Germany | 222/145 |

OTHER PUBLICATIONS

Photocopies of Emhart's "Molly Parafast" resin mortar cartridge.

Product Literature of Celtites "Anchor Bond" tube.

*Primary Examiner*—Michael S. Huppert

*Attorney, Agent, or Firm*—John M. Lynn

[57] ABSTRACT

This invention relates to a hand held, totally integrated dispenser for mixing and dispensing two viscous components. The dispenser includes a hollow plunger within a generally cylindrical outer chamber. The hollow plunger has an open ended container attached to its proximal end. The hollow plunger is used to mix the two viscous components and as a dispensing nozzle.

5 Claims, 2 Drawing Sheets

HAND HELD DISPENSER FOR MIXING AND DISPENSING TWO VISCOUS COMPONENTS

BACKGROUND

Hand held dispensers (caulkers) are widely used as dispensing containers for sealants, adhesives and other caulking compounds. However, dispensers that contain two viscous components which must be stored separately and then mixed immediately before use are not widely used because of the following practical problems:

(1) It is difficult to get complete mixing of the two viscous components prior to the material being dispensed. Some systems rely on mixing nozzles which depend on exact metering of the two components to the mixer. This complicates the system and can cause inadequate mixing;

(2) Current systems are messy and complicated because they often contain two or more separate pieces. For instance one system in current use relies upon a non-integrated two-piece tube (part hollow and part solid) which is used as both a rod to push the catalyst out of a catalyst containing tube and later as the dispensing nozzle. This causes a more complicated system requiring eight steps in the mixing instructions;

(3) It is difficult to get adequate mixing using hand powered means, and, therefore, one caulking system requires the use of an electric drill to generate the energy needed to satisfactorily mix the two components. Obviously, this is not only an inconvenience, but it further complicates the procedure and poses risk of injury during the mixing stage of the operation.

There is a need for a economical, simple, totally integrated hand held two-component dispenser which does not require a separate power source to assure adequate mixing. Such a caulker would allow the widespread use of two-component hand held caulkers.

SUMMARY OF THE INVENTION

This invention relates to an improved hand held dispenser for mixing and dispensing two viscous components. Our inventive caulker is a totally integrated assembly (i.e., no separate parts to be assembled), simple to use and requires no separate power source to mix the two viscous components. The invention includes a hollow plunger arranged within a generally cylindrical outer chamber. The proximal end of the outer chamber has a moveable plug. The proximal end of the hollow plunger has an open container which prior to use abuts the moveable plug and is separated from the interior cavity of the hollow plunger by a seal. The distal end of the outer chamber has an integral closing means which is circumferentially and tightly mounted around the distal end of the hollow plunger. The distal end of the hollow plunger has a handle which is used for pumping the hollow plunger and the container. After mixing the components, the seal is broken, and the hollow plunger is used as a dispensing nozzle.

DETAILED DESCRIPTION

Figure 1:
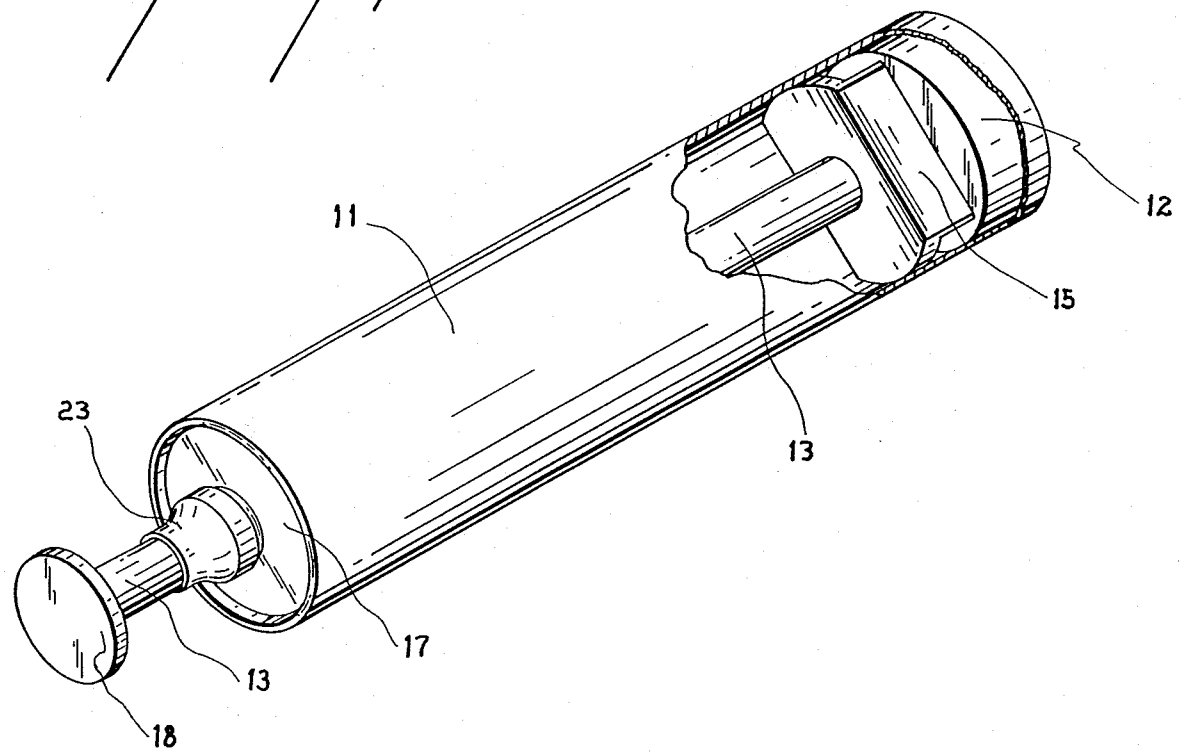
FIG. 1 is a partially cut away, side elevational view of a preferred embodiment of the inventive dispenser.
Figure 2:
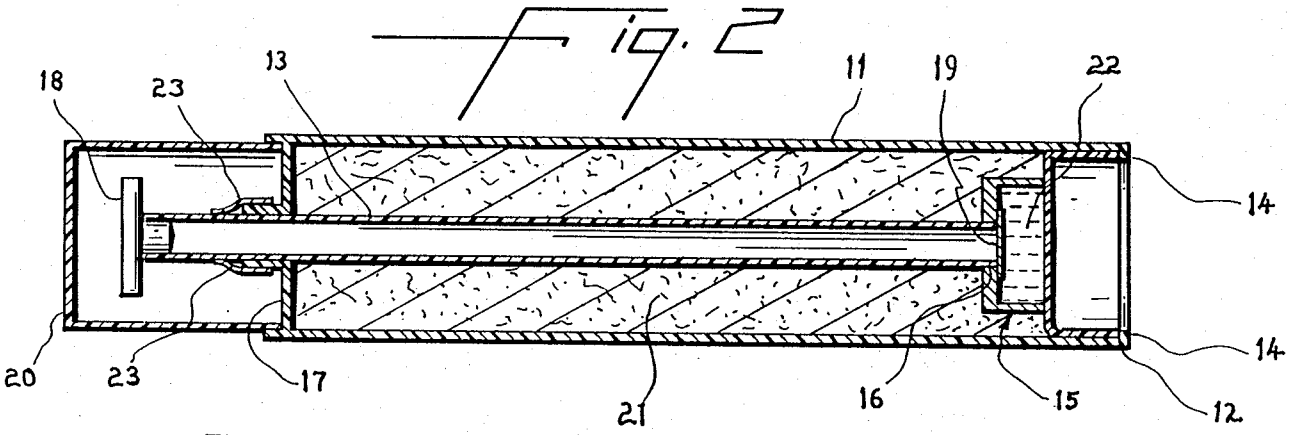
FIG. 2 is cross-sectional view of the dispenser in FIG. 1.

A preferred embodiment shown in FIG. 1 includes a hollow plunger 13 with container 15 attached to its proximal end, arranged within a generally cylindrical outer chamber 11. As shown in FIG. 2, the annular space between hollow plunger 13 and outer chamber 11 is filled with first viscous component 21. The proximal end of outer chamber 11 is open with an annular rib 14 extending into the opening. A moveable plug 12 which is fitted tightly but slideably within outer chamber 11 abuts rib 14 and therefore plug 12 is prevented from sliding out of the proximal end of outer chamber 11. Other means to prevent plug 12 from exiting the proximal end of outer chamber 11 will be apparent to those skilled in the art. Attached to the proximal end of hollow plunger 13 is container 15. Container 15 is filled with second viscous component 22. Container 15 contains opening 19 such that the interior cavity in hollow plunger 13 is separated from the interior of container 15 solely by a seal 16. The opposite end of container 15 is open.

Integral to the distal end of outer chamber 11 is closing means 17 circumferentially and slideably mounted around hollow plunger 13. Attached to the distal end of hollow plunger 13 is handle 18.

Container 15 is designed such that second viscous component 22 is kept separate from first viscous component 21 prior to use of the dispenser. Since one end of container 15 is open, this is accomplished by abutting the open end of container 15 against plug 12 such that plug 12 becomes a wall of container 15. This configuration allows mixing of the two viscous components by pulling container 15 away from plug 12.

The initial relative positioning (with container 15 abutting plug 12) is maintained by positioning means 23. Any of a number of different types of positioning means (e.g., aluminum tape) are known to those skilled in the art. Positioning means 23 adheres hollow plunger 13 to closing means 17 thus assuring that container 15 abuts plug 12 so that second viscous component 22 remains isolated from first viscous component 21.

The distal end of outer container 11 may also contain cap 20 whose only purpose is to protect the distal end of plunger 13, closing means 17, seal 23 and handle 18.

Figure 3:
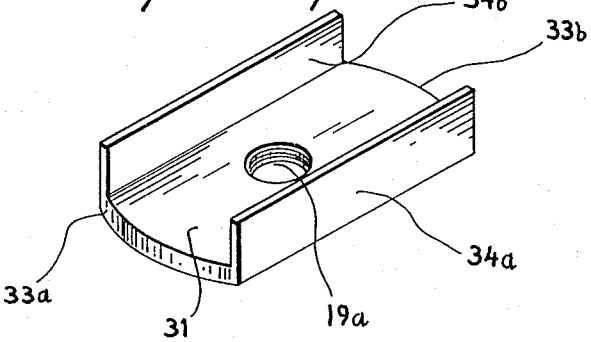
FIG. 3 is an enlarged isometric view of a preferred embodiment of the container.

The configuration of container 15 has a significant effect on how well the two viscous components will mix. Although any number of different configurations for container 15 are possible, our preferred embodiment gives surprisingly better mixing than other possible configurations. In the preferred embodiment, as shown in FIG. 3, container 15 comprises a base 31 with side walls **34*a* and 34*b* and threaded opening 19*a*. Threaded opening 19*a* serves as both the attachment means to hollow plunger 13 and the opening connecting the interior of container 15 with the cavity of hollow plunger 13. (Prior to use of the dispenser, threaded opening 19 is covered by seal 16.) Alternatively, plunger 13 may be welded or pressed into container 15. Base 31 is substantially rectangular except that the two opposite ends 33*a* and 33*b* are rounded to conform tightly but slideably to the inner walls of outer chamber 11. Using this configuration allows the inner walls of outer chamber 11 to serve as both a stabilizing guide means for container 15 and hollow plunger 13, and as end walls for container 15**.

Figure 4:
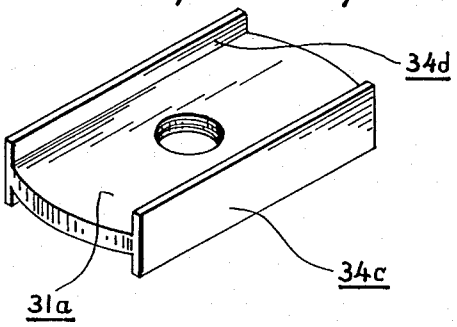
FIG. 4 is an enlarged isometric view of an alternative preferred embodiment of the container.

In an alternative preferred embodiment of container 15, as shown in FIG. 4, the container is exactly as shown in FIG. 3 except that side walls 34*c* and 34*d* extend below base 31*a*.

Various materials of construction may be used. In a preferred embodiment high density polyethylene is used, but other satisfactory thermoplastic or thermosetting resins such as polyethylene terephthalate, and polystyrene will be apparent to those skilled in the art.

OPERATION OF THE DISPENSER

Immediately prior to its use the two viscous components are thoroughly mixed. Mixing is accomplished by removing cap 20 and positioning means 23. This allows plunger 13 and container 15 to move relative to outer chamber 11. Handle 18 is used to hand pump plunger 13. The plunger should be pumped 10–20 times. As the plunger is pumped back and forth, viscous component 22 is released from container 15 and distributed throughout outer chamber 11. Rotation of plunger 13 can also help facilitate the mixing process but is not necessary. Seal 16 must be able to withstand the pumping action. In one embodiment, not shown, handle 18 can be designed to accommodate a power drill so that the power drill can be used to pump and rotate plunger 13.

After mixing of the components, plunger 13 is completely extended thereby positioning container 15 in abutting relationship with the inside of closing means 17.

Hollow plunger 13 is then cut to a desired length to be used as a dispensing nozzle. Seal 19 is punctured by sticking a nail or some other long sharp object down through the opening in hollow plunger 13. The dispenser can then be placed into any standard caulking gun and is ready for use. The two blended components are squeezed out of the dispenser as plug 12 is advanced into outer chamber 11 through the action of the caulking gun plunger.

I claim:

1. A hand held dispenser for mixing and dispensing first and second viscous components comprising:

(a) a hollow plunger having a distal and proximal end arranged within a generally cylindrical outer chamber having an inner wall and a distal and proximal end, said distal end of the plunger extending beyond the distal end of said outer chamber and said outer chamber containing the first viscous component;

(b) a plug slideably fitted into the outer chamber and means to prevent said plug from exiting the proximal end of the outer chamber;

(c) closing means for the distal end of said outer chamber, said closing means circumferentially and slideably mounted around said hollow plunger;

(d) a container, for storing said second viscous component, attached to the distal end of the plunger, the container having an attachment end and an opposing open end, the attachment end having an opening in communication with the hollow portion of the plunger;

(e) a seal covering said opening in the attachment end of the container;

(f) a handle attached to the distal end of said plunger; and (g) a removeable positioning means to position the plunger and container in relation to said outer chamber.

2. A dispenser as in claim 1 in which the material of construction for all component parts of the dispenser is high density polyethylene.

3. A dispenser as in claim 1 in which the proximal end of said hollow plunger is threaded and said opening in the attachment end of said container is complementarily threaded to mate with said threaded end of the hollow plunger.

4. A dispenser as in claim 3 in which the container comprises a substantially rectangular base containing said threaded opening, upturned side walls, and rounded ends conforming tightly but slideably to the inner wall of the outer chamber.

5. A dispenser as in claim 1 in which said positioning means comprises tape adhered to said closing means and said hollow plunger.

* * * * *